US007932802B2

(12) United States Patent
Wei et al.

(10) Patent No.: US 7,932,802 B2
(45) Date of Patent: Apr. 26, 2011

(54) MEANDER INDUCTOR AND SUBSTRATE STRUCTURE WITH THE SAME

(75) Inventors: Chang-Lin Wei, Hsinchu (TW); Chang-Sheng Chen, Taipei (TW); Cheng-Hua Tsai, Taipei County (TW); Kuo-Chiang Chin, Taipei County (TW); Chin-Sun Shyu, Pingtung County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/016,213

(22) Filed: Jan. 18, 2008

(65) Prior Publication Data

US 2009/0072942 A1 Mar. 19, 2009

(30) Foreign Application Priority Data

Sep. 19, 2007 (TW) ..... 96134864 A

(51) Int. Cl.

| | |
|---|---|
| ***H01F 5/00*** | (2006.01) |
| ***H01F 29/02*** | (2006.01) |
| ***H01F 27/28*** | (2006.01) |
| ***H01F 27/29*** | (2006.01) |

(52) U.S. Cl. ..... 336/200; 336/146; 336/147; 336/180; 336/192; 336/222; 336/223; 336/232

(58) Field of Classification Search ..... None
See application file for complete search history.

(56) References Cited

U.S. PATENT DOCUMENTS

| | | | | |
|---|---|---|---|---|
| 3,492,665 | A * | 1/1970 | Stoehr | 365/55 |
| 3,656,230 | A * | 4/1972 | Hardung-Hardung | 29/604 |
| 4,626,814 | A * | 12/1986 | Montuschi et al. | 335/281 |
| 5,373,112 | A * | 12/1994 | Kamimura et al. | |
| 6,175,727 | B1 * | 1/2001 | Mostov | |
| 6,320,491 | B1 * | 11/2001 | Gevorgian et al. | 336/200 |
| 6,384,705 | B1 * | 5/2002 | Huang et al. | 336/200 |
| 6,713,162 | B2 * | 3/2004 | Takaya et al. | 428/209 |
| 6,800,936 | B2 * | 10/2004 | Kosemura et al. | 257/748 |
| 7,030,721 | B2 * | 4/2006 | Yoshida et al. | 333/246 |
| 7,310,040 | B2 * | 12/2007 | Sakamoto | 336/200 |
| 2002/0070837 | A1 * | 6/2002 | Iida et al. | 336/200 |
| 2005/0116802 | A1 * | 6/2005 | Gomez et al. | 336/200 |
| 2006/0158293 | A1 * | 7/2006 | Inuzuka | 336/83 |
| 2007/0247268 | A1 * | 10/2007 | Oya et al. | 336/200 |
| 2008/0122568 | A1 * | 5/2008 | Yan et al. | 336/200 |

* cited by examiner

*Primary Examiner* — Anh T Mai
*Assistant Examiner* — Mangtin Lian
(74) *Attorney, Agent, or Firm* — Jianq Chyun IP Office

(57) ABSTRACT

A meander inductor is disclosed, the inductor is disposed on a substrate or embedded therein. The meander inductor includes a conductive layer composed of a plurality of sinusoidal coils with different amplitudes and in series connection to each other, wherein the sinusoidal coils with different amplitudes are laid out according to a periphery outline. The profile of the meander inductor is designed according to an outer frame range available for accommodating the meander inductor and is formed by coils with different amplitudes. Therefore, under a same area condition, the present invention enables the Q factor and the resonant frequency fr of the novel inductor to be advanced, and further expands the applicable range of the inductor.

8 Claims, 11 Drawing Sheets

CONVENTIONAL MEANDER INDUCTOR

NOVEL MEANDER INDUCTOR

| TYPE | INDUCTANCE (nH) | Q | SRF (GHz) |
|---|---|---|---|
| CONVENTIONAL | 8.4 | 30 | 5.4 |
| THE PRESENT INVENTION | 8.49 | 35(+16.7%) | 5.9 (+9.2%) |

| TYPE | INDUCTANCE (nH) | Q | SRF(GHz) |
|---|---|---|---|
| CONVENTIONAL | 10 | 33 | 5.68 |
| THE PRESENT INVENTION | 10 | 38(+15%) | 5.8(+2%) |

MEANDER INDUCTOR AND SUBSTRATE STRUCTURE WITH THE SAME

CROSS-REFERENCE TO RELATED APPLICATION

This application claims the priority benefit of Taiwan application serial no. 96134864, filed on Sep. 19, 2007. The entirety of the above-mentioned patent application is hereby incorporated by reference herein and made a part of this specification.

BACKGROUND OF THE INVENTION

1. Field of the Invention

The present invention generally relates to an inductor, and more particularly, to a meander inductor structure and a substrate with the meander inductor.

2. Description of Related Art

Inductor devices have been broadly applied to a resonator, a filter or an impedance converting device. However, a small-size inductor device is usually soldered on a circuit board by using a complicate surface mounted technique (SMT). Although an inductor device today can be made in a miniature size, but the industry practice still need a plurality of inductor devices disposed on the surfaces of a multi-layers substrate, which increases the surface area and height of a solid circuit.

In order to embed an inductor device inside a multi-layers circuit substrate, many domestic or foreign developers have made an effort to make an inductor device embedded into a multi-layers PCB (printed circuit board) substrate and further applicable to various electronic circuits for years.

To design a high-frequency circuit module, the Q factor of an inductor device is a very significant parameter to affect communication quality. An inductor with a lower Q factor would reduce the overall circuit transmission efficiency. For example, when an inductor with the lower Q factor is applied to a filter of a communication system, it results in an increasing insertion loss within the filter frequency band, a broader bandwidth and introduces a greater noise. On the other hand, when an inductor with the lower Q factor is applied to an oscillator circuit, it results in an increasing output phase noise of the oscillator, which makes demodulating the modulation signal of a communication system more difficult.

In addition to the Q factor, another significant design parameter is self-resonant frequency (SRF) $f_r$ of an inductor device, in which the SRF $f_r$ restricts the operation frequency range of the inductor device. In other words, the operation frequency of the inductor device must be lower than the resonant frequency so as to keep a desirable inductor characteristic.

The U.S. Pat. No. 6,175,727 'Suspended Printed Inductor And LC-Type Filter Constructed Therefrom' provides a suspended printed inductor, referring to FIG. 1, a side view diagram of a conventional suspended printed inductor. In an architecture 100, two metallic covers 110 and 120 are respectively disposed over and under a PCB 130, wherein the metallic covers 110 and 120 are grounded and enclose a suspended printed inductor 140. The suspended printed inductor 140 has two terminals 142 and 144, in which the terminal 142 is connected to an external circuit via a trace 150. In the suspended printed inductor 140 provided by the patent, the ground is located at a distance upwards or downwards from the inductor by 10 times of the substrate thickness so as to minimize a possible parasitic effect and to gain a high Q factor. FIG. 2 is a top view diagram of another conventional suspended printed inductor 200. Both the above-mentioned architectures have a major disadvantage that the process for fabricating a suspended printed inductor is more complicate than a traditional PCB process so that it is not suitable for a low-cost consumer product.

The U.S. Pat. No. 6,800,936 'high-frequency module device' provides a high-frequency module device, and FIGS. 3A and 3B are respectively a sectional diagram and a top view diagram of the architecture of high-frequency module device. Referring to FIGS. 3A and 3B, a high-frequency device layer 302 is formed on a substrate 304, and the substrate 304 has a plurality of conductive layers, such as 340 and 342 etc. as shown by FIG. 3A. The high-frequency device layer 302 includes an inductor device 300, a thin film coil spiral pattern 310, an embedded conductor pattern 320 and a pullout conductor pattern 330. At the conductive layers of the substrate 304, for example, at the layers 340 and 342, wiring inhibition regions are respectively formed, and the wiring inhibition regions are located under the inductor device 300 and are not conductive. The inductor device built on a multi-layers substrate in this way, since the metal conductor under the inductor device is removed by using etching process, the parasitic effect is reduced, which is able to appropriately increase the Q factor of the inductor, and the method is similar to the traditional PCB process suitable for a low-cost commercial product.

SUMMARY OF THE INVENTION

Accordingly, in order to increase the Q factor and resonant frequency of an inductor device, the present invention is directed to a meander inductor structure and a substrate structure with the meander inductor.

In an embodiment, the meander inductor provided by the present invention is disposed on a plane substrate. The meander inductor includes a conductive layer composed of a plurality of sinusoidal coils with different amplitudes and in series connection to each other, wherein the conductive layer having sinusoidal coils with different amplitudes is laid out according to a periphery outline.

In an embodiment, the multi-layers substrate structure provided by the present invention includes a substrate and a meander inductor. The substrate is composed of a dielectric layer and the meander inductor is disposed on the substrate. In another embodiment, the substrate is formed by a plurality of stacked dielectric layers and a plurality of conductive lines is disposed therein. The meander inductor is disposed on the substrate or embedded on any one of the dielectric layers in the substrate.

The meander inductor includes a conductive layer composed of a plurality of sinusoidal coils with different amplitudes and in series connection to each other, wherein the conductive layer composed of the above-mentioned sinusoidal coils with different amplitudes is laid out according to a periphery outline.

In the above-mentioned meander inductor, the periphery outline can be one of rectangle, square, rhombus, circle, triangle or any geometric figure.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 2:
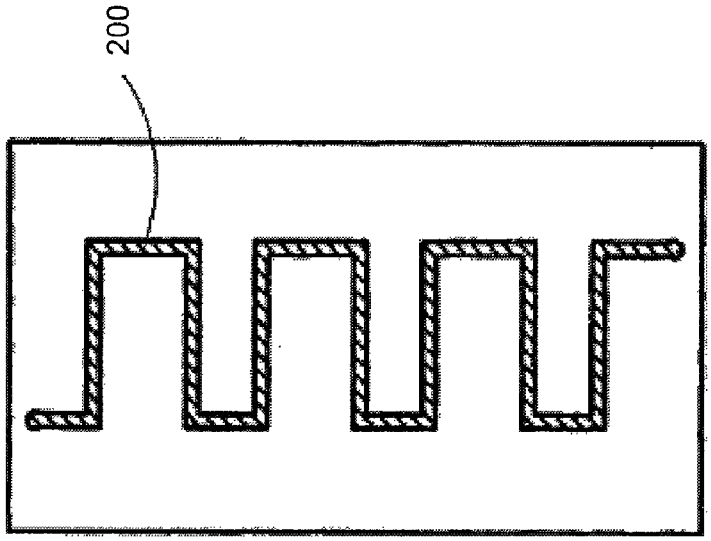
FIG.2 (PRIOR ART)
FIGS. 1 and 2 are respectively a side view diagram of a conventional suspended printed inductor and a top view diagram of another conventional suspended printed inductor.
Figure 1:
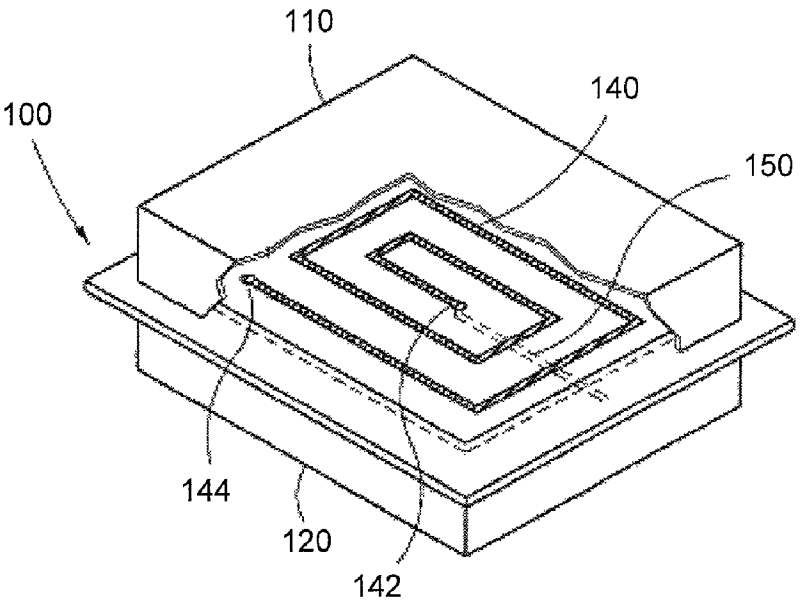
FIG.1 (PRIOR ART)
Figure 3B:
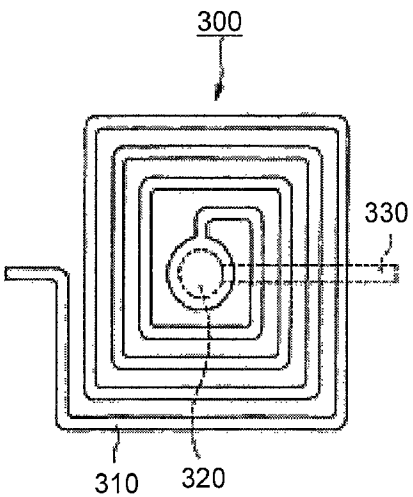
FIG. 3B (PRIOR ART)
FIGS. 3A and 3B are respectively a sectional diagram and a top view diagram of architecture of high-frequency module device.
Figure 3A:
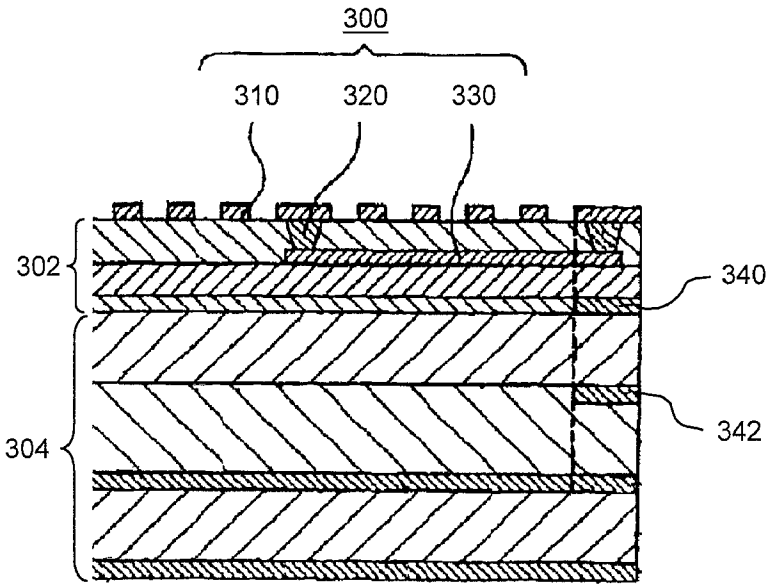
FIG. 3A (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

The present invention provides a meander inductor disposed on a plane substrate. The meander inductor includes a conductive layer composed of a plurality of sinusoidal coils with different amplitudes.

In an embodiment, the present invention provides a single-layer substrate structure with a meander inductor, which includes a substrate and a meander inductor. The substrate herein is made of dielectric material and the meander inductor is disposed on the substrate. In another embodiment, the substrate is formed by a plurality of stacked dielectric layers and a plurality of conductive lines is disposed in the substrate. The meander inductor is disposed on the substrate or embedded on any one of the dielectric layers in the substrate.

The meander inductor includes a conductive layer composed of a plurality of sinusoidal coils with different amplitudes and in series connection to each other, wherein the conductive layer composed of the above-mentioned sinusoidal coils with different amplitudes is laid out according to a periphery outline. In the above-mentioned meander inductor, the periphery outline can be one of rectangle, square, rhombus, circle, triangle or any geometric figure.

The present invention provides a novel meander inductor able to increase the operation frequency of an inductor device and make integrate the meander inductor with a PCB substrate easier and suitable for a high density interconnection (HDI) trace, which enables the meander inductor to be broadly applicable to various high-frequency circuit modules and products, for example, filter, resonator, frequency divider, oscillator, matching net, receiver module, transmitter module and various commercial high-frequency products.

Figure 4B:
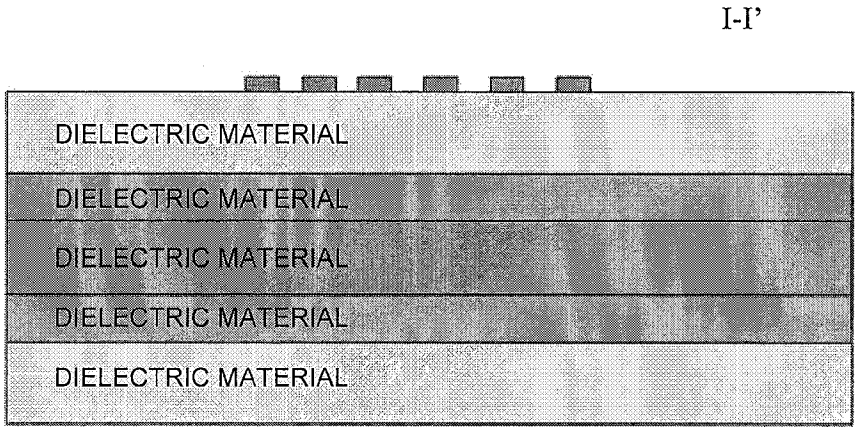
FIGS. 4A and 4B are structure diagrams showing a meander inductor.
Figure 4A:
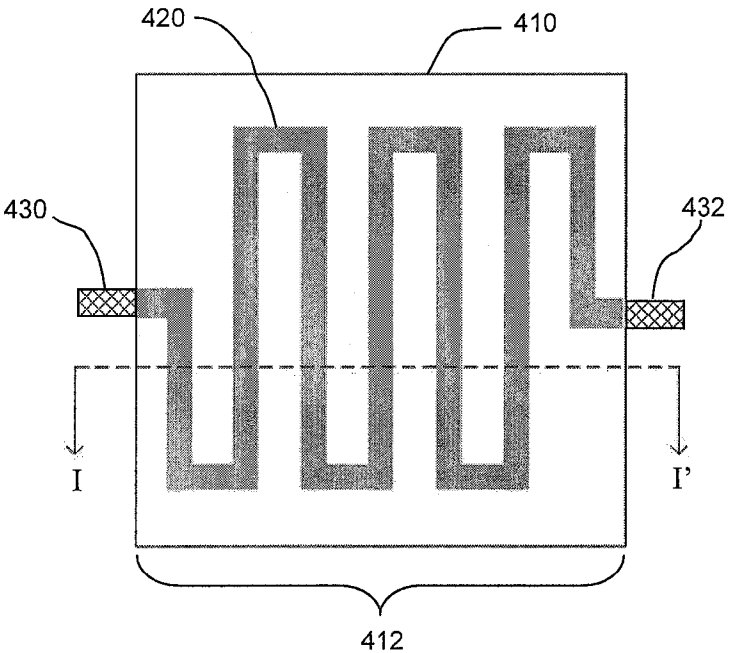
Figure 4C:
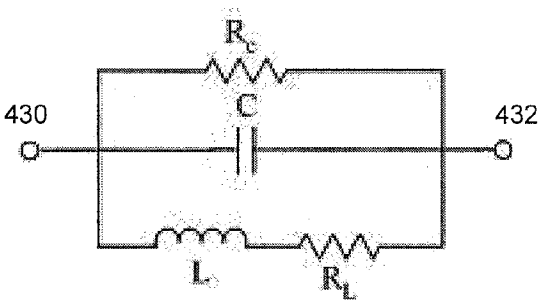
FIG. 4C is an equivalent circuit of the above-mentioned meander inductor.

Referring to FIGS. 4A and 4B, they are structure diagrams showing a meander inductor. In a device region 410, both terminals of a meander inductor 420 are respectively connected to conductive lines 430 and 432, while the meander inductor 420 is formed by winding a wire to be sinusoid-like. The equivalent circuit of the meander inductor 420 is shown by FIG. 4C, wherein L represents inductance, $R_C$ represents loss in dielectric, $R_L$ represents loss in metal and C is parasitic capacitance.

The Q factor and the resonant frequency $f_r$ of the meander inductor 420 can be expressed by the following formulas:

$$Q = \frac{R_C\omega(L - \omega^2 L^2 C - R_L^2 C)}{R_L^2 + R_C R_L + \omega^2 L^2} \tag{1}$$

$$f_r = \frac{1}{2\pi\sqrt{LC}} \tag{2}$$

Figure 4D:
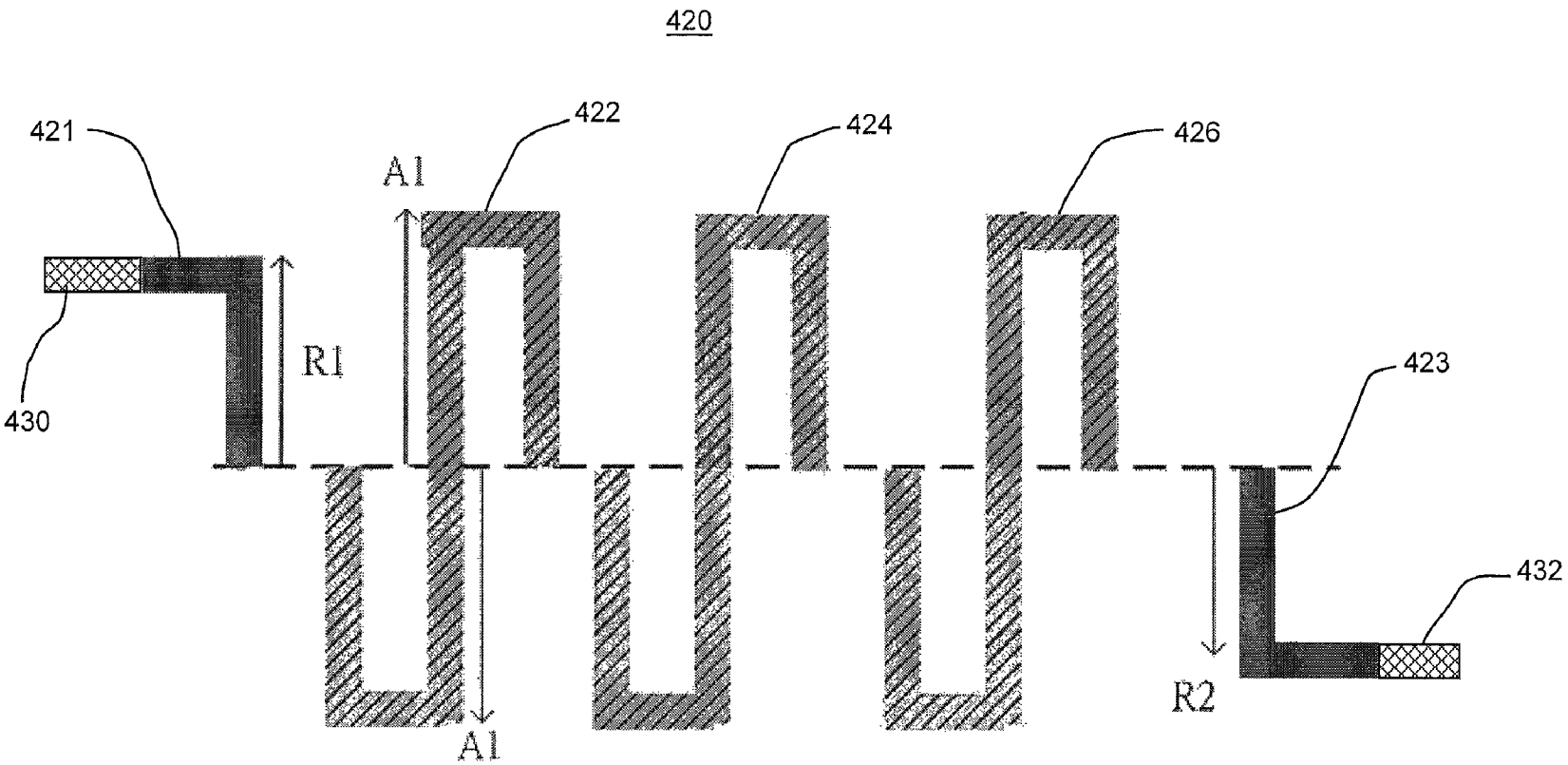
FIG. 4D is a diagram showing how a meander inductor is composed of a plurality of sinusoid-like coils.

FIG. 4D is a diagram showing how a meander inductor 420 is composed of a plurality of sinusoid-like coils. The meander inductor 420 can be seen as a combination of a plurality of sinusoid-like coils with a same amplitude A1 (reference numbers 422, 424 and 426, as shown in FIG. 4D). The diagram is schematically illustrated for better depiction where the meander inductor 420 is separated into a plurality of sinusoid-like segments and looks uncontinue. To match with an application circuit, two internal traces 421 and 423 are respectively connected between both terminals of the meander inductor 420 and two conductive lines 430 and 432, in which the arrangement makes the overall periphery outline looks like a rectangle. The meander inductor 420 rests in a single-layer configuration, no need of additional vias and area-saving of the circuit layout.

Theoretically, in particular according to the above-mentioned formulas (1) and (2), in order to increase the operation frequency of the inductor, the Q factor or the self-resonant frequency (SRF) $f_r$ of the meander inductor must be increased which accordingly lowers the parasitic capacitance.

Figure 5A:
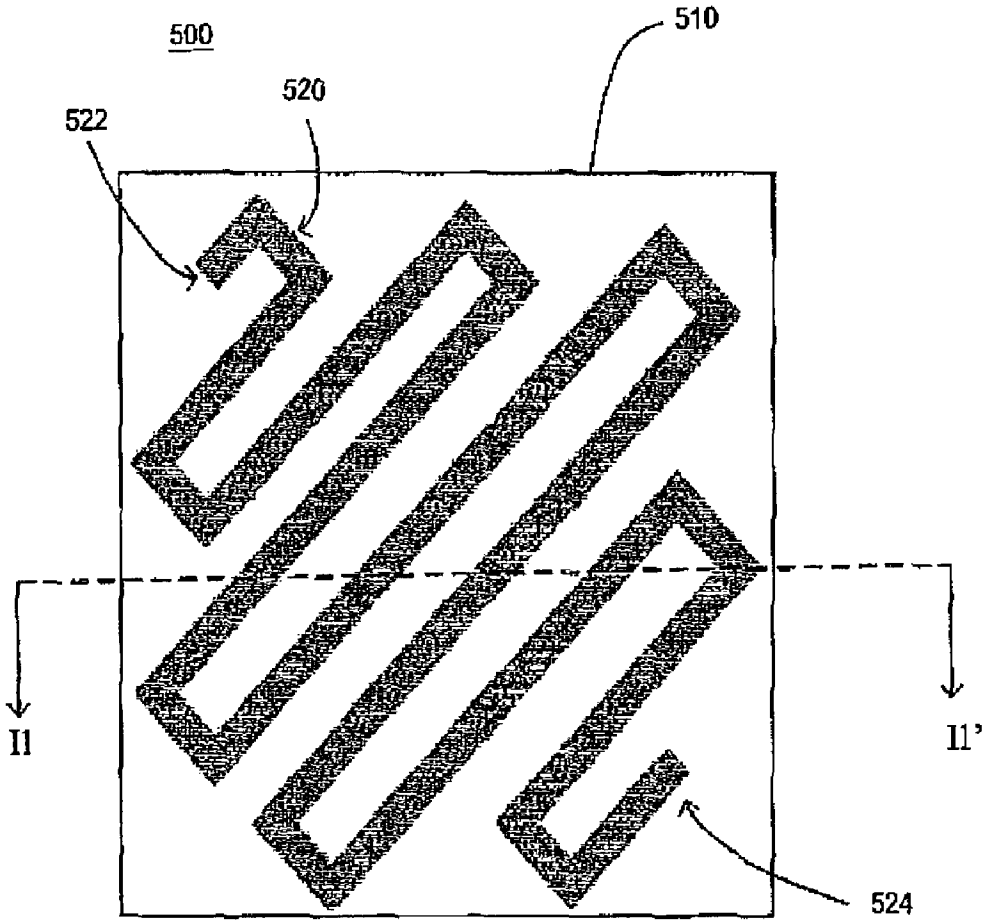
FIG. 5A is a diagram of a multi-layers PCB structure with a novel meander inductor according to an embodiment of the present invention.

The present invention also provides a novel meander inductor as shown by FIG. 5A, a diagram of a multi-layers PCB structure 500 with a novel meander inductor according to an embodiment of the present invention. In other embodiments, the novel meander inductor can also be formed in a ceramic substrate or an IC substrate. In one embodiment, the multi-layers PCB structure 500 includes materials with relatively high permeability, for example, may have a permeability larger than 1.1 and may be selected from ferrum (Fe), cobalt (Co) or nickel (Ni).

Figure 5C:
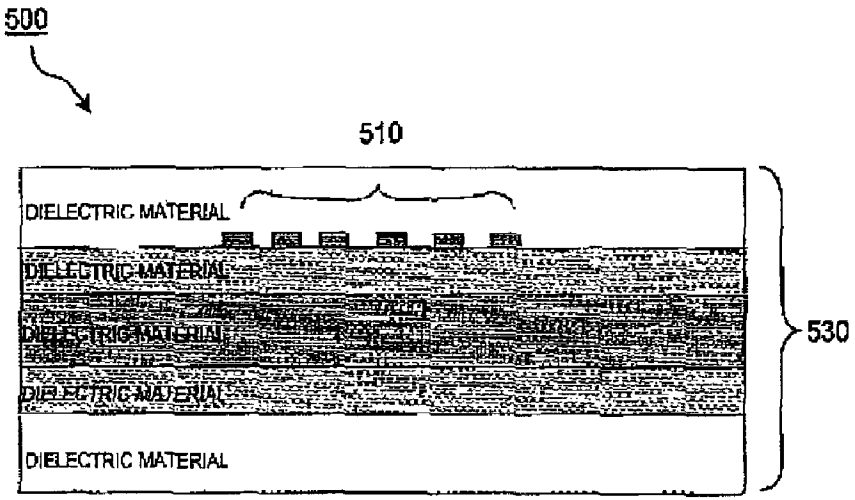
FIGS. 5B and 5C are two sectional diagrams of the multi-layers PCB structure in FIG. 5A along line II-II' respectively according to two embodiments of the present invention.
Figure 5B:
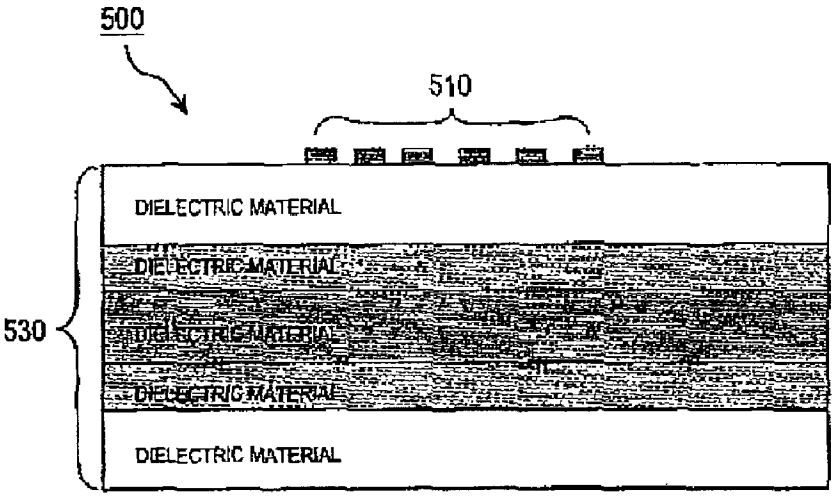

The periphery outline of the novel meander inductor mainly depends on an outer frame range in a substrate available for accommodating the meander inductor. For example, the meander inductor in FIG. 5A takes a rectangular region 510 as the periphery outline thereof which is able to provide the most effective layout. The meander inductor 520 includes many coils with different sizes, wherein each coil has a different amplitude. Both terminals 522 and 524 of the meander inductor 520 are respectively connected to the conductive lines of an external circuit or to other conductive layers/conductive lines of the multi-layers PCB structure 500 through vias. FIG. 5B is a sectional diagram of the multi-layers PCB structure 500 in FIG. 5A along line wherein a multi-layers substrate 530 includes a plurality of dielectric layers and the meander inductor 520 is formed on the multi-layers substrate 530. In another embodiment, as shown by FIG. 5C, the meander inductor 520 is formed in one of the layers in the multi-layers substrate 530.

In the embodiment, the outline of the meander inductor 520 is designed according to an outer frame range in the substrate available for accommodating a meander inductor therewithin and a spiral pattern with different amplitudes is able to achieve the optimal inductor characteristic under a same area. Consequently, the parasitic capacitance between coils is lowered which advances the Q factor and resonant frequency $f_r$ of the meander inductor, and expands the operable range in applications.

Figure 6:
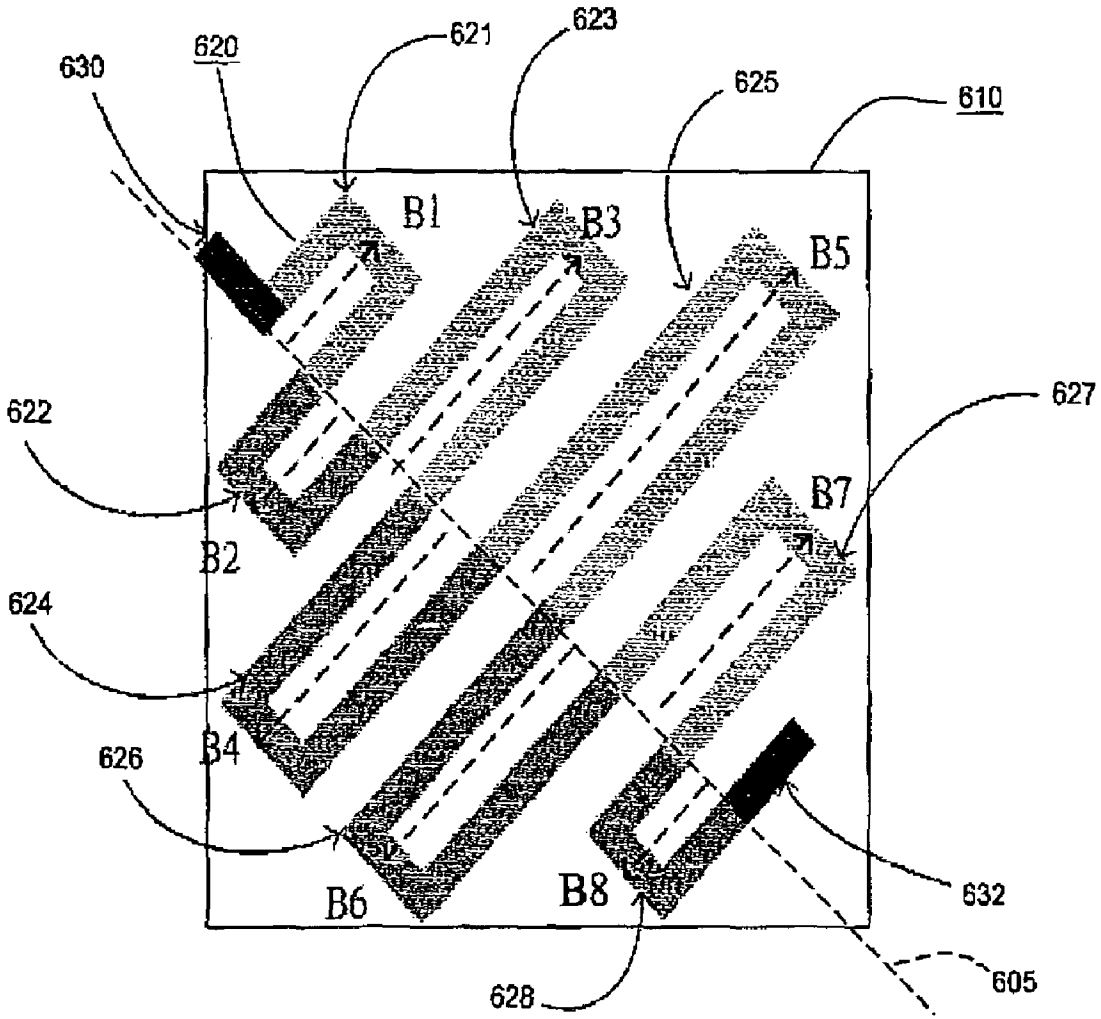
FIG. 6 is a meander inductor pattern on a substrate or in a layer of a multi-layer substrate where the pattern is designed based on a periphery outline according to an embodiment of the present invention.

In order to more clearly describe the outline design of the meander inductor provided by the present invention, in particular, to better illustrate how a meander inductor is formed by winding wire within an outer frame range on a substrate or in one of multi-layers, referring to FIG. 6. Within a region 610 available for accommodating a meander inductor, a meander inductor 620 is composed of a plurality of semi-sinusoidal or sinusoidal meander conductors, for example, eight semi-sinusoidal meander conductors 621-628, which are nearly-symmetrically arranged about a bevel line 605 close to the diagonal of the region 610 and respectively have different winding amplitudes B1-B8. The inductor 620 also includes two terminals 630 and 632. The amplitudes herein are designed mainly according to the distances the region 610 is able to cover, for example, the winding amplitude B5 is longer than B1. Such a design is mainly to suit the outer frame range size available for accommodating the meander inductor on the substrate or in one of the multi-layers.

Figure 7A:
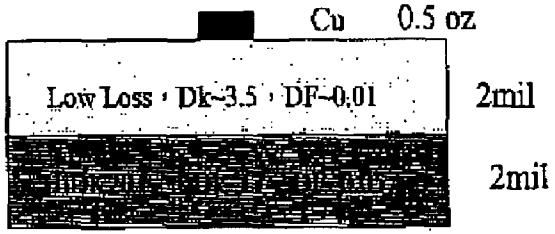
FIGS. 7A-7D are diagrams respectively showing two pattern layouts of a meander inductor of the present embodiment and a conventional inductor both with a same enclosing area (60 mil×100 mil, 1 mil=0.0254 mm) and a result comparison of high-frequency scattering parameter simulation experiments.
Figure 7B:
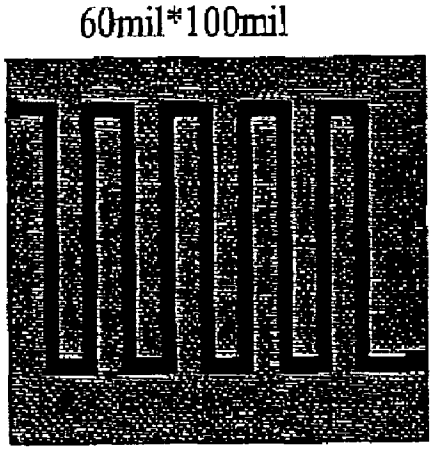
Figure 7C:
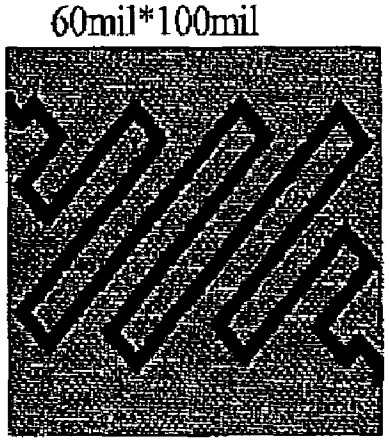
Figure 7D:
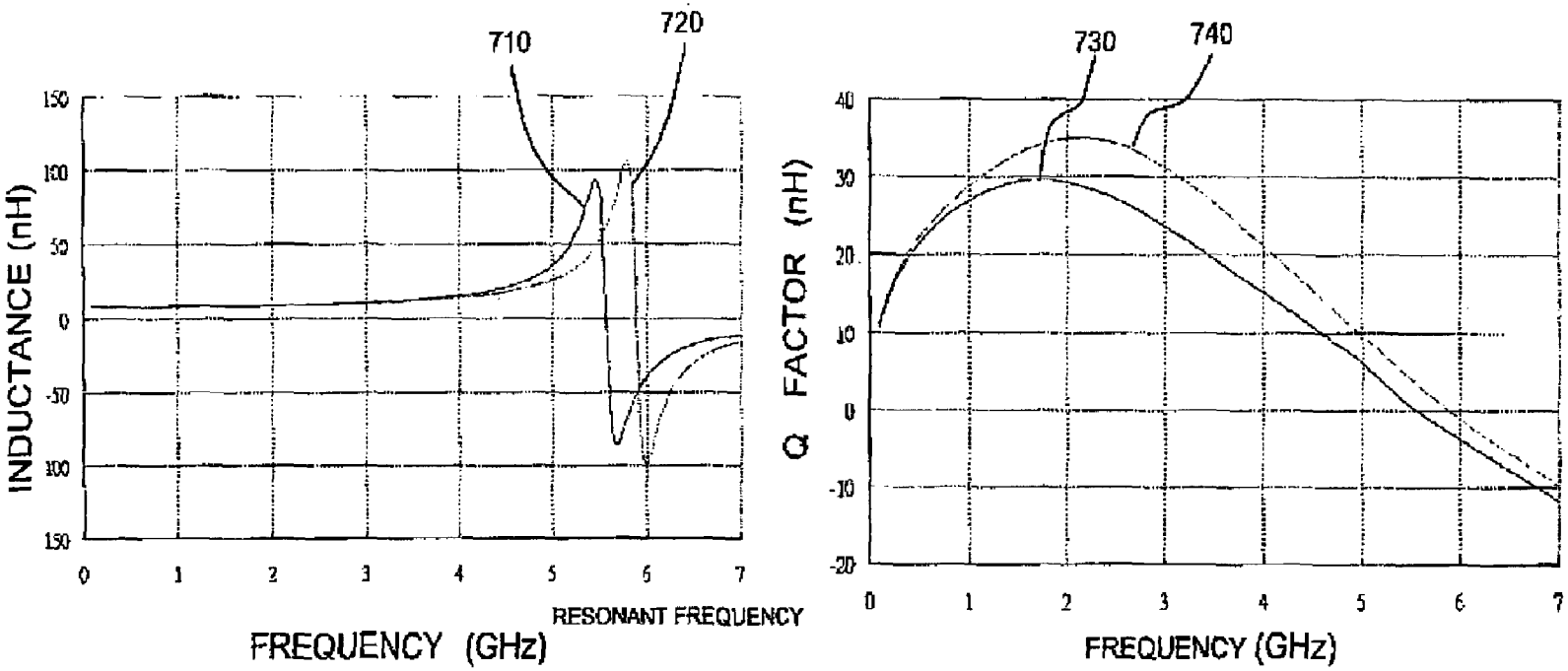

To prove the affectivity of the present invention in advancing the Q factor or resonant frequency of the meander inductor, a simulation software of high-frequency electromagnetic field SONNET is used to conduct simulation experiments of high-frequency scattering parameters. First, taking the same substrate structure and the same parameters thereof as shown by FIG. 7A, a meander inductor of the present invention and a conventional meander inductor are formed on a structure with stacked dielectric layers with a thickness of 2 mil (1 mil=0.0254 mm) respectively for one of the two layers. The structure with stacked dielectric layers includes a dielectric layer made of Hi-DK 20, wherein dielectric constant (DK) is about 17, and dissipation factor (DF) is about 0.05 and another low-loss dielectric layer made of (DK is about 3.5 and DF is about 0.01). The two meander inductors have a same region of 60 mil×100 mil. As shown by FIGS. 7B and 7C, FIG. 7B is a conventional meander inductor, while FIG. 7C is the novel meander inductor of the present invention. FIG. 7D shows the high-frequency performance comparison, where the upper-left diagram illustrates the simulation results of inductance vs. frequency including 710 for the prior art and 720 for the present invention; the upper-right diagram illustrates the simulation results of Q factor versus frequency including 730 for the prior art and 740 for the present invention. It can be seen from the simulation results that the Q factor of the novel meander inductor is higher than the conventional one by about 16.7%, while the resonant frequency SRF is higher than the conventional one by 9.2%.

Figure 8B:
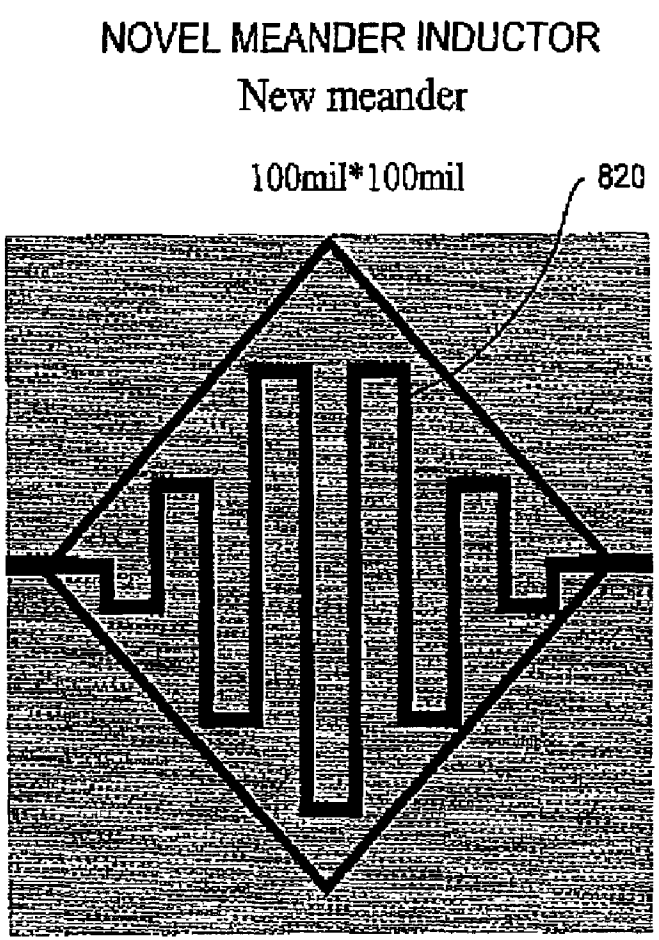
FIGS. 8A-8C are diagrams respectively showing two pattern layouts of a meander inductor of the present embodiment and a conventional inductor both with a same enclosing area (100 mil×100 mil, 1 mil=0.0254 mm) and a result comparison of high-frequency scattering parameter simulation experiments.
Figure 8A:
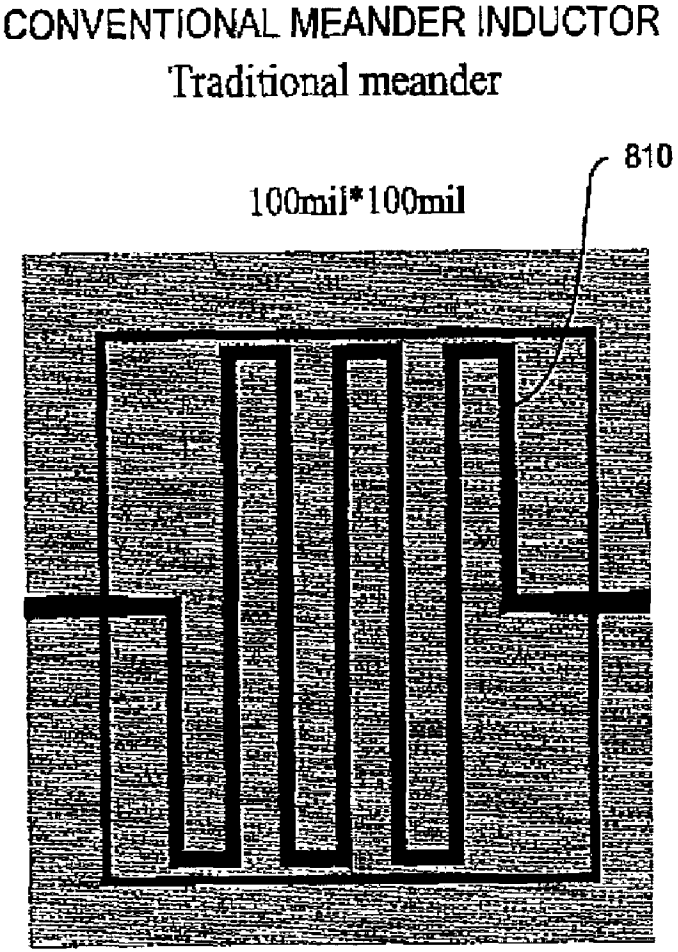
Figure 8C:
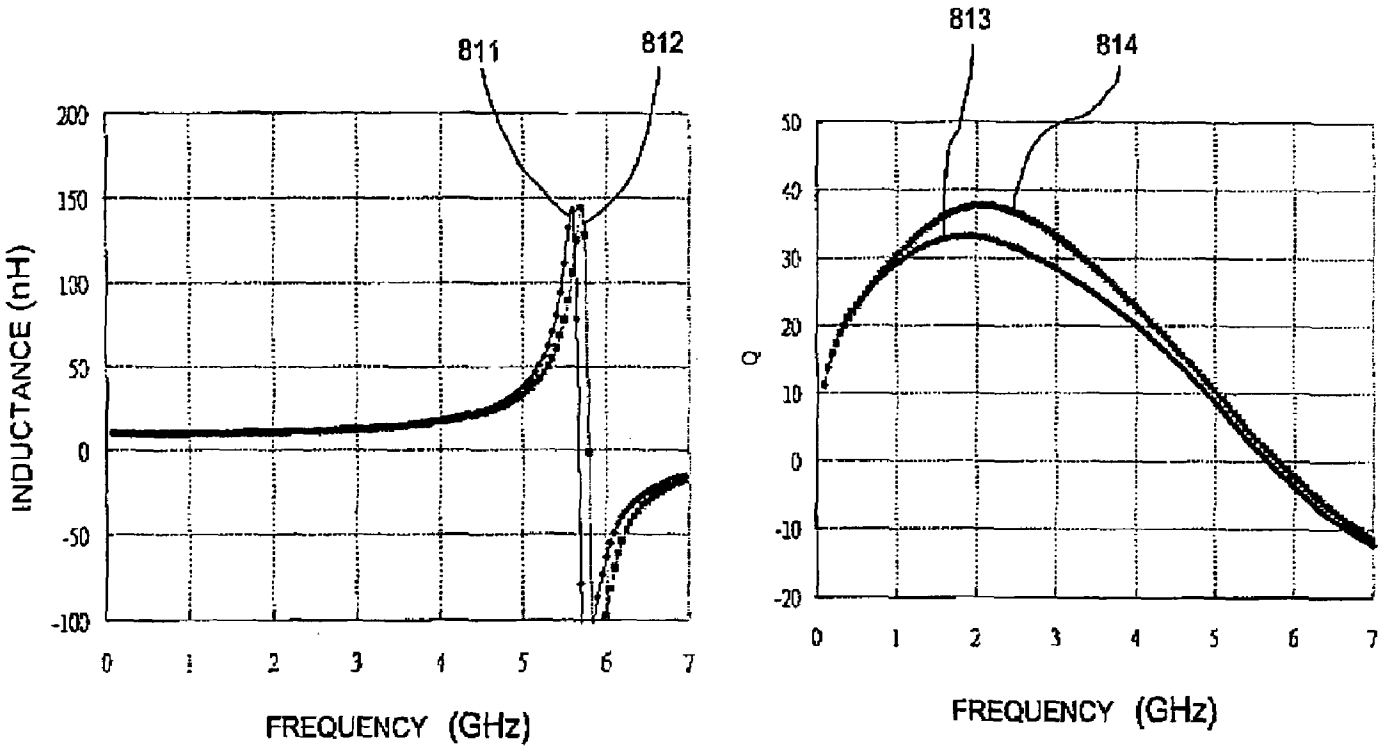

To further obtain the high-frequency performance difference between the novel meander inductor and the conventional one, another area of 100 mil×100 mil as the region area is chosen. As shown by FIGS. 8A and 8B, FIG. 8A is a conventional meander inductor 810, while FIG. 8B is the novel meander inductor 820 of the present invention. FIG. 8C shows the high-frequency performance comparison, where the upper-left diagram illustrates the simulation results of inductance vs. frequency including 811 for the prior art and 812 for the present invention; the upper-right diagram illustrates the simulation results of Q factor with frequency including the reference number 813 for the prior art and the reference number 814 for the present invention. It can be seen from the simulation results that the Q factor of the novel meander inductor is higher than the conventional one by about 15%, while the resonant frequency SRF is higher than the conventional one by 2%.

In summary, the outline design of a meander inductor provided by the present invention is based on an outer frame range in the substrate available for accommodating the meander inductor. Therefore, under a same area, the present invention is able to advance the Q factor and the self-resonant frequency $f_r$, of the meander inductor, and to expand the operable range in applications.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A multi-layers substrate structure having a meander inductor, comprising:

a rhombus substrate, comprising a plurality of stacked dielectric layers; and a meander inductor, embedded on any one of the dielectric layers and comprising at least four sinusoidal coils with different amplitudes and in series connection to each other, wherein no other conductor layer is embedded on the dielectric layers except the meander inductor, a direction of the amplitudes is parallel to a diagonal line of the rhombus substrate, and the amplitudes of the sinusoidal coils closer to a center point between two terminals of the meander inductor are greater than the amplitudes of the sinusoidal coils farther away from the center point.

2. The multi-layers substrate structure according to claim 1, wherein the rhombus substrate is a printed circuit board, a ceramic substrate or an IC substrate.

3. The multi-layers substrate structure according to claim 1, wherein the dielectric layers of the rhombus substrate comprise a material with a relatively high permeability larger than 1.1.

4. The multi-layers substrate structure according to claim 3, wherein the material is selected from a group consisting of ferrum (Fe), cobalt (Co) and nickel (Ni).

5. A multi-layers substrate structure having a meander inductor, comprising:

an oblong rectangular substrate, comprising a plurality of stacked dielectric layers; and a meander inductor, embedded on any one of the dielectric layers and comprising at least four sinusoidal coils with different amplitudes and in series connection to each other, wherein no other conductor layer is embedded on the dielectric layers except the meander inductor, a direction of the amplitudes substantially deviates from both length and width directions of the oblong rectangular substrate, and the amplitudes of the sinusoidal coils closest to a center point between two terminals of the meander inductor are greater than the amplitudes of the sinusoidal coils farthest away from the center point.

6. The multi-layers substrate structure according to claim 5, wherein the oblong rectangular substrate is a printed circuit board, a ceramic substrate or an IC substrate.

7. The multi-layers substrate structure according to claim 5, wherein the dielectric layers of the oblong rectangular substrate comprise a material with a relatively high permeability larger than 1.1.

8. The multi-layers substrate structure according to claim 7, wherein the material is selected from a group consisting of ferrum (Fe), cobalt (Co) and nickel (Ni).

* * * * *